US005873788A

United States Patent [19]

Hoffman

[11] Patent Number: 5,873,788

[45] Date of Patent: Feb. 23, 1999

[54] GRIP CONTROL GLOVE

[76] Inventor: Saul Hoffman, 102 E. 78th St., New York, N.Y. 10021

[21] Appl. No.: 56,856

[22] Filed: Apr. 8, 1998

Related U.S. Application Data

[60] Provisional application No. 60/072,631 Jan. 27, 1998.

[51] Int. Cl.[6] ..... A63B 69/36

[52] U.S. Cl. ..... 473/205; 434/252; 2/161.2

[58] Field of Search ..... 434/252; 473/205, 473/201; 2/161.1, 161.2, 161.3, 161.4

[56] References Cited

U.S. PATENT DOCUMENTS

| | | | |
|---|---|---|---|
| 2,787,003 | 4/1957 | Parlanti | 2/161.2 |
| 3,111,322 | 11/1963 | English | 473/205 |
| 4,000,903 | 1/1977 | Swanson | 473/205 |
| 4,488,726 | 12/1984 | Murray | 473/205 |
| 4,524,973 | 6/1985 | Sterbik | 473/300 |
| 4,589,146 | 5/1986 | Taylor | 2/161.2 |
| 4,776,595 | 10/1988 | Wilkins | 473/205 |
| 4,861,034 | 8/1989 | Lee | 473/226 |
| 4,930,785 | 6/1990 | Mills | 473/226 |
| 5,232,225 | 8/1993 | Snyder | 473/205 |
| 5,462,280 | 10/1995 | Dickerson | 473/205 |
| 5,542,126 | 8/1996 | Harvanek | 2/161.2 |
| 5,634,214 | 6/1997 | St. Ville | 2/161.2 |

*Primary Examiner*—Klen T. Nguyen

[57] ABSTRACT

A grip control glove for teaching proper pressure for gripping sports equipment includes a number of semi-sharp, tack-like units attached to the glove at pressure points where the user typically tends to grip the equipment too tightly. Each tack-like unit includes a disc-shaped head portion and a semi-sharp protrusion which extends perpendicularly from the center of one side of the head portion. The tips of the semi-sharp protrusions, which extend toward the user's hand, are sufficiently sharp to cause discomfort when pressed firmly against the palm or fingers, but not sharp enough to break the skin or cause injury. When the equipment is gripped too tightly, the semi-sharp protrusions press into the fingers or the hand of the user, causing a degree of discomfort. This discomfort serves as direct biofeedback to the user, indicating that his or her grip is too tight and reminding the user to relax his or her grip. Repeated use of the grip control glove trains the user to use proper grip pressure, which improves the user's swing. The tack-like units can be permanently attached to the glove at predetermined positions or removably attached to the glove, such that the positions of the tack-like units can be adjusted in accordance with the user's needs.

18 Claims, 2 Drawing Sheets

GRIP CONTROL GLOVE

CROSS REFERENCE TO RELATED APPLICATIONS

This application claims priority from U.S. Provisional patent application Ser. No. 60/072,631, entitled "Grip Control Glove", filed Jan. 27, 1998. The disclosure of that provisional patent application is incorporated herein by reference in its entirety.

BACKGROUND OF THE INVENTION

1. Field of the Invention

The present invention relates to a grip control glove designed to teach proper grip pressure when swinging an item of sports equipment or the like. In particular, the present invention relates to a grip control glove which uses the principle of biofeedback to teach proper grip pressure.

2. Description of the Related Art

In sports that require grasping and swinging of a piece of equipment, such as golf, baseball, tennis and the like, it is important to maintain proper grip pressure while swinging the equipment. For example, in golf, there is a tendency to grip the golf club too tightly while swinging the club. It has long been understood that a tight grip hinders the release of the clubhead in the hitting area, causing the club speed to be reduced and the ball to travel less distance. Conversely, a relaxed grip (i.e., a light grip pressure) allows the hands to move faster through the ball with a more complete follow-through, resulting in greater hitting distance (see, e.g., *GOLF DIGEST*, September 1985, p. 85; Febuary 1986, p. 200; December 1987, p. 32; April 1991, p. 39; *GOLF*, October 1988, p. 38; April 1989, p. 68; *GOLF WORLD*, November 1990, p. 87). A relaxed grip has similar benefits in other sports that require a swinging motion.

Several glove-based aids designed to improve grip in some manner have been proposed. For example, U.S. Pat. No. 2,787,003 to Parlanti discloses a golf glove having attached thereto one portion of a fastener, such as a snap fastener, and golf club handle having attached thereto a mating portion of the fastener. When the two portions of the fastener are engaged, the fastener ensures proper placement of the user's hand on the golf club.

U.S. Pat. No. 4,000,903 to Swanson discloses a golf glove having a raised ridge or bead extending across the palm to abut the handle grip of a golf club and guide the user's hand to the proper grip position.

U.S. Pat. No. 4,589,146 to Taylor discloses a glove, such as a golf glove, having projections extending laterally outward from the palm-side thereof, which provide a more secure grip on a golf club or the like.

U.S. Pat. No. 4,776,595 to Wilkins discloses a golf club grip positioning aid comprising a glove having a grip position indicator disposed within the thumb portion of the glove. The indicator includes an elongated, triangularly-shaped strip. The strip is oriented such that, when the grip position of the thumb is improper, one of the elongated edges of the strip impinges on the user's thumb to urge the user to correct the grip position.

U.S. Pat. No. 5,232,225 to Snyder discloses a golf glove grip positioning aid. Each of two gloves has self-gripping tapes disposed on an outer surface thereof. The tapes are of the hook and loop type and form a bond with a corresponding material on the golf club grip to ensure a proper grip position.

U.S. Pat. No. 5,462,280 to Dickerson discloses a golf grip training glove having corresponding hook and loop strips on respective left and right golf gloves. When the grip position on the golf club is correct, the strips are aligned and interlocked. The left-hand glove further includes a different color strip indicating the correct contact point of the left hand on the golf club.

U.S. Pat. No. 5,542,126 to Harvanek discloses a glove, such as a golf glove, having markings formed thereon which provide the user with a visual indication of the proper gripping position. A proper gripping position can be obtained by aligning the markings with the golf club handle.

U.S. Pat. No. 5,634,214 to St. Ville discloses a golf glove having a padded strip and a visual indicator to assist in gripping a golf club in the proper position.

The gloves disclosed in the above patents either aid in proper hand positioning or provide a more secure grip. None of these gloves addresses the problem of proper gripping pressure.

U.S. Pat. No. 4,488,726 to Murray discloses a sports training glove having pressure actuated switches for ensuring a firm grip on a golf club or tennis racket. Rubber pad pressure-operated switches are secured to the inside gripping surface of the glove. When a golf club is firmly gripped, all of the switches are held open by the pressure; however, if the grip is relaxed below a predetermined level, an alarm will be sounded to warn the user that the grip should be tightened. While this system addresses the issue of gripping pressure, it is concerned with too little pressure and is thus not suitable for preventing excessive gripping pressuring and teaching a relaxed grip. Thus, there are no known glove-based devices which are useful for teaching relaxation of grip.

A number of gripping aid devices that are situated on the handle portion of a golf club have been proposed. For example, U.S. Pat. No. 3,111,322 to English discloses a golf club handle formed with protuberances having rough outer surfaces for warning the user of application of excessive force.

U.S. Pat. No. 4,524,973 to Sterbik discloses a golf club handle which compensates for gripping pressure differences between the upper and lower hands. The handle includes spring-biased upper and lower depressor pads positioned in opposite sides of a tubular housing. Levers within the housing couple the relative movements of the pads such that inward movement of one pad produces outward movement of the other pad.

U.S. Pat. No. 4,861,034 to Lee discloses a golf grip training device designed to be attached and removed from the handle of a golf club. An elongated, pressure sensitive switch comprising resilient conductive strips is mounted on the underside of the handle and is response to the grip pressure of the golfer. When excessive pressure is applied, the switch closes, thereby activating a buzzer which produces an audible signal.

U.S. Pat. No. 4,930,785 to Mills discloses a golf club training apparatus which includes a handle-mounted switch that is activated in response to improper grip pressure during the golf club swing. The switch activates a motor disposed within the shaft of the golf club, which generates vibrations alerting the golfer of the excessive pressure.

These handle-mounted golf club training devices tend to be complex and require either augmentation of a golf club by positioning the device on the handle of the golf club or a specially designed club dedicated to the purpose of grip control training. Consequently, these devices are typically expensive, cumbersome to employ, and have golf club handles which differ significantly in shape and feel from those of normal (nontraining) golf clubs. Accordingly, there remains a need for an affordable device capable of teaching proper grip pressure which can be conveniently used without requiring modification or augmentation of the golf club.

The disclosures of all of the above-referenced publications and patents are incorporated herein by reference in their entirety.

SUMMARY OF THE INVENTION

It is an object of the present invention to teach the proper pressure with which to grip an item of sports equipment using a glove device to be worn on the hand.

It is a further object of the present invention to use the principle of biofeedback to teach proper grip pressure in an effective manner.

Another object of the present invention is to teach proper grip pressure under normal playing conditions using conventional swinging equipment, such as golf clubs or the like, without modification of the shape or feel of the handle of the equipment.

Yet another object of the present invention is to provide an affordable device for teaching proper gripping pressure.

The aforesaid objects are achieved individually and in combination, and it is not intended that the present invention be construed as requiring two or more of the objects to be combined unless expressly required by the claims attached hereto.

According to the present invention, a grip control glove for teaching proper grip pressure of sports equipment includes a number of semi-sharp, tack-like units. Each tack-like unit includes a disc-shaped head portion and a semi-sharp protrusion which extends perpendicularly from the center of one side of the head portion. Several tack-like units are attached to the glove at pressure points where the user typically tends to grip the equipment too tightly, with the semi-sharp protrusions facing inward toward the hand. The tips of the semi-sharp protrusions are sufficiently sharp to cause discomfort when pressed firmly against the palm or fingers of the user, but not sharp enough to break the skin or cause injury.

The grip control glove of the present invention uses the principle of biofeedback to teach proper grip pressure. When the equipment is gripped too tightly, the semi-sharp, tack-like units press into the fingers or the hand of the user, causing an uncomfortable sensation, the degree of which corresponds to the degree of excess pressure. This discomfort serves as direct biofeedback to the user, indicating that his or her grip is too tight and reminding the user to relax his or her grip. Repeated use of the grip control glove tends to train the user to use proper grip pressure, which improves the user's swing. The biofeedback provided by the glove of the present invention is a more direct form of feedback than the audible or vibrational feedback of known devices and provides a more effective means of teaching proper grip pressure. Further, the biofeedback is a sensation that inherently indicates the degree of excess pressure, and thereby provides a more precise feedback of the degree of excess pressure.

According to one embodiment of the invention, the tack-like units are permanently attached to the glove at predetermined positions. According to another embodiment, the tack-like units are removably attached to the glove, and the positions of the tack-like units can be adjusted in accordance with the user's needs.

Unlike known grip pressure teaching devices that are mounted on the handle of a particular golf club or the like, the grip control glove of the present invention can be used with conventional golf clubs, and only a single glove (or pair of gloves) is required to achieve training benefits with any number of different golf clubs. Further, the user can practice and play with same set of golf clubs without any difference in the shape, feel and weight of the golf club handle. Thus, with the grip control glove of the present invention, the training conditions are more similar to non-training conditions than with known golf club handle training devices.

Further, the grip control glove of the present invention does not require a power source, pressure sensors, electronics, motors or alarms and is thus less costly than known devices which indicate grip pressure.

The above and still further objects, features and advantages of the present invention will become apparent upon consideration of the following detailed description of a specific embodiment thereof, particularly when taken in conjunction with the accompanying drawings wherein like reference numerals in the various figures are utilized to designate like components.

DESCRIPTION OF THE PREFERRED EMBODIMENTS

Figure 2:
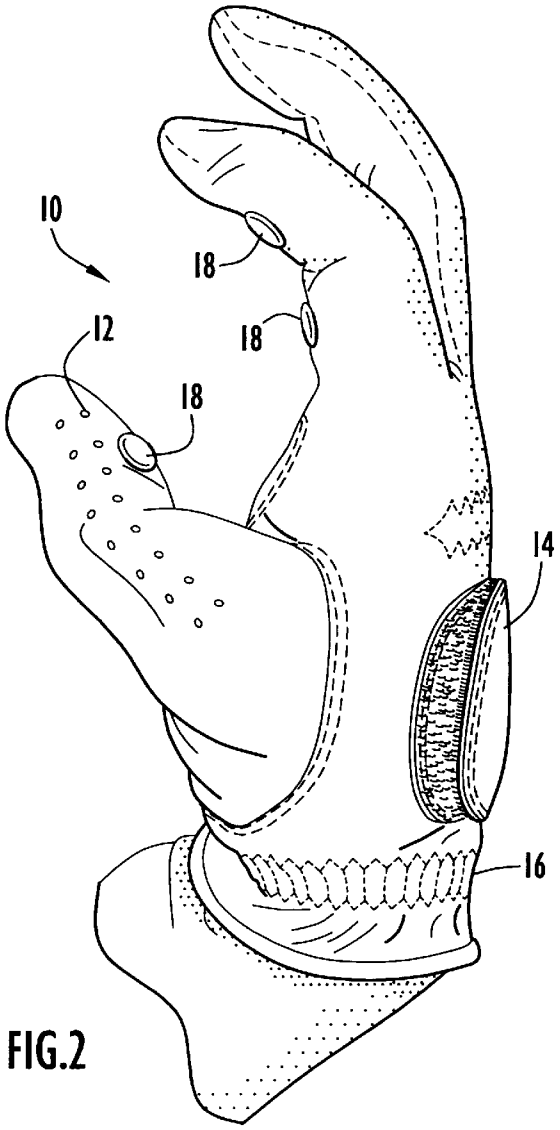
FIG. 2 is a perspective view of the grip control glove of the present invention from the thumb side.
Figure 1:
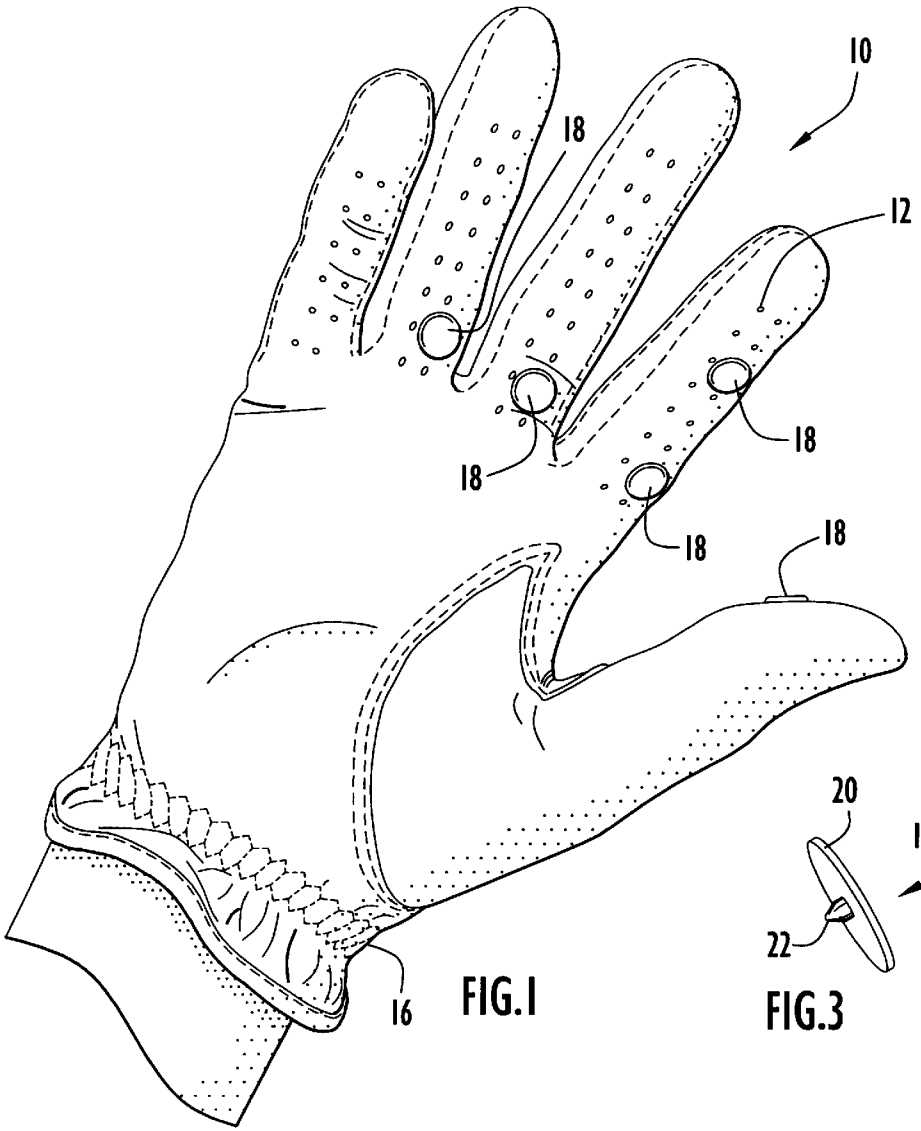
FIG. 1 is a perspective view of the palm side of a grip control glove according to an exemplary embodiment of the present invention.

FIG. 1 is a perspective view of the palm side of a grip control glove 10 according to an exemplary embodiment of the present invention. FIG. 2 is a perspective view of grip control glove 10 from the thumb side. Glove 10 can be made of leather, fabric or any other conventional material. One glove 10 can be worn on a single hand of the user, or two different gloves 10 can be worn on the user's two hands, respectively. Glove 10 can include other conventional features, such as finger air holes 12, a hook and loop fastener 14 which allows the user to adjustably tighten glove 10 for a snug fit, and an elastic band 16 disposed near the opening of glove 10, which band contacts the user's wrist when glove 10 is worn.

Figure 3:
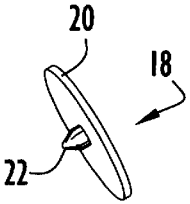
FIG. 3 is a perspective view of a tack-like unit having a head portion and a semi-sharp protrusion.

The grip control glove of the present invention uses the principle of biofeedback to teach proper grip pressure. Specifically, glove 10 includes a number of rigid, semi-sharp, tack-like units 18. As shown in FIG. 3, each tack-like unit 18 includes a head portion 20 and a semi-sharp protrusion 22. Head portion 20 is preferably disc-shaped with first and second opposing sides that are circular and generally flat and smooth. Semi-sharp protrusion 22 extends from the center of the second side of head portion 20 in a direction perpendicular to the surface of the second side. More particularly, semi-sharp protrusion 22 is a generally conical or cylindrical shaft that narrows at the distal tip to a dull point. That is, the tip of semi-sharp protrusion 22 is sufficiently sharp to cause discomfort when pressed firmly against the palm or fingers of the user, but is not sharp enough to break the skin or cause injury.

Head portion 20 and semi-sharp protrusion 22 are preferably made of a rigid or nearly rigid material, including, but not limited to, plastic, metal or very hard rubber, such that virtually no bending or flexing of semi-sharp protrusion 22 and head portion 20 occurs during use. Preferably, head-portion 20 is approximately 8 millimeters in diameter, and semi-sharp protrusion 22 is approximately 4 millimeters in length. While the head portion 20 shown in the exemplary embodiment has a circular disc shape, it will be understood that the shape of head portion 20 can be other than circular (e.g., elliptical, square, rectangular, etc.), and "disc-shaped" is defined herein to encompass generally flat members having a circular or other shape.

As shown in FIGS. 1 and 2, a number of tack-like units 18 are attached to glove 10 at pressure points where the user typically tends to grip an item of sports equipment, such as a golf club, too tightly. For example, tack-like units 18 are disposed along the fingers of glove 10 on the palm side thereof, near the base of the fingers. More than one tack-like unit 18 may be used for a single finger, as shown for the index finger in FIG. 1. For a golf glove, the preferable positions are at the base of the ring, middle and index fingers and at the tip of the index finger and thumb, since these positions correspond to the points at which excess pressure is typically applied. Depending upon the particular item of sports equipment and the particular user, it may be preferable to position tack-like units 18 at different points within the finger portions or on the palm portion of glove 10.

The first side of head portion 20 of each tack-like unit 18 faces outward from the exterior surface of glove 10 and comes into contact with the equipment (e.g., a golf club) when gripped by the user. The second side of head portion 20 of each tack-like unit 18 faces the exterior surface of glove 10 and is attached thereto. The tack-like protrusion 22 of each tack-like unit 18 extends through a corresponding opening in glove 10 and comes into direct contact with the user's skin when glove 10 is worn on the user's hand. To avoid the need for a hole through glove 10, head portion 20 can instead be disposed within glove 10, with the first surface of head portion 20 being attached to an interior surface of glove 10.

According to one embodiment of the invention, the second side of each tack-like unit 18 is permanently attached to the exterior surface of glove 10 at a predetermined position, such that the positions of the tack-like units 18 cannot be adjusted.

According to another embodiment, each tack-like unit 18 is removably attached to the exterior surface of glove 10 using, for example, a hook and loop fastener. Specifically, one portion of the hook and loop fastener 24 is affixed to the second side of each tack-like unit 18 (see FIG. 5), and an attachment strip 26 of the other portion of the hook and loop fastener is affixed to the exterior surface of glove 10, with openings 28 formed in strip 76 and in glove 10 at each position that tack-like units 18 can be attached (see FIG. 4).

Figures 4, 5:
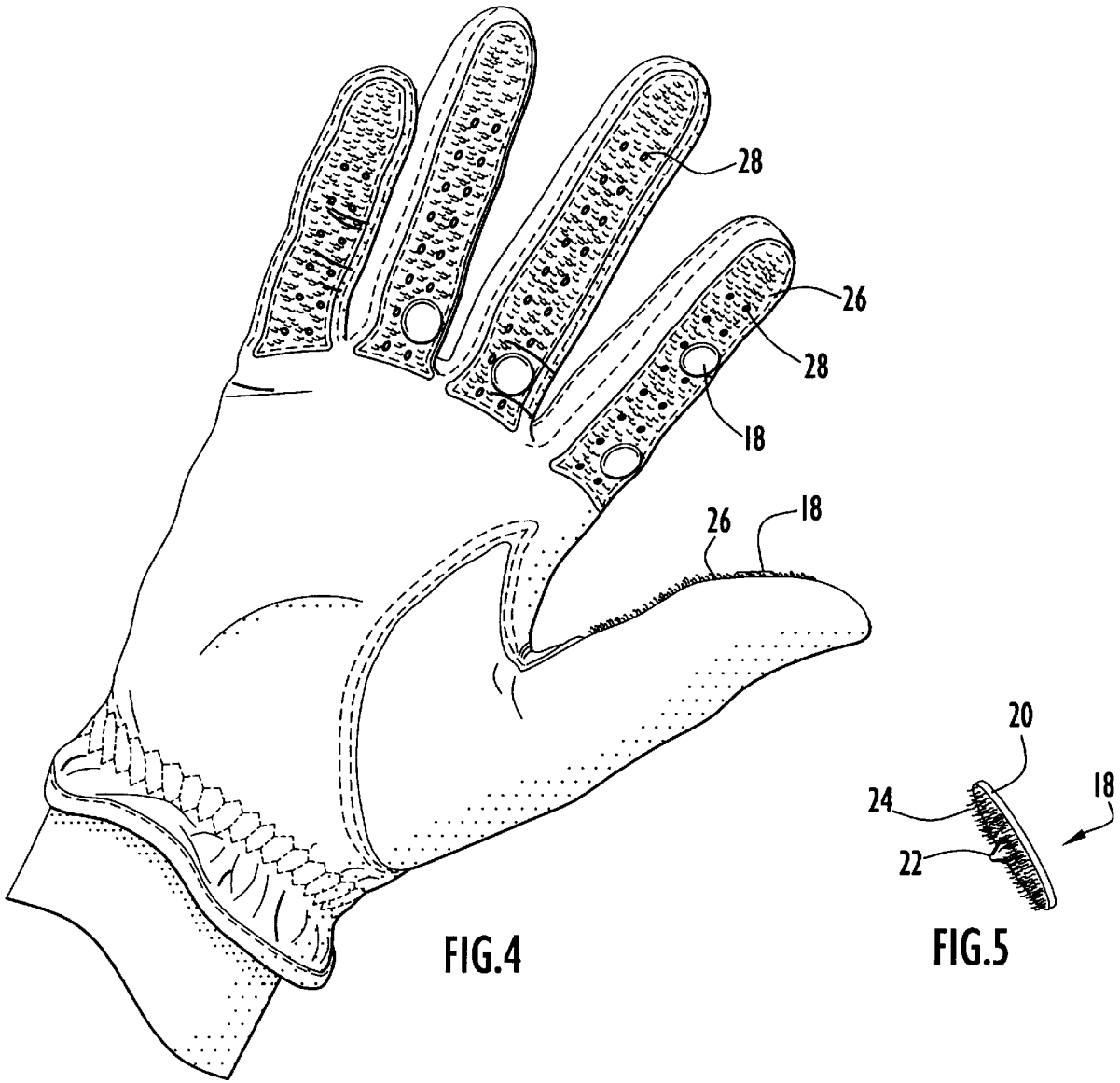
FIG. 4 is a perspective view of the palm side of a grip control glove having attachment strips on which the tack-like units are adjustably attached.
FIG. 5 is a perspective view of a removable tack-like unit used with the grip control glove shown in FIG. 4.

As shown in FIG. 4, strip 26 comprises one portion of a hook and loop fastener and can be attached to the outer surface of glove 10 along the palm-side of a finger, with periodic holes 28 in the fastener to accommodate the semi-sharp protrusion 22 of a tack-like unit 18. According to this embodiment, the position of tack-like units 18 can be adjusted by the user to accommodate the user's specific needs. To avoid the need for a plurality of holes through strips 26 and glove 10, strips 26 can be attached to an interior surface of glove 10 along the fingers, with the first surface of head portion 20 being removably attached thereto by a hook and loop mechanism.

When gripping too tightly, the semi-sharp, tack-like units 18 press into the fingers or the hand of the user, causing a poking sensation with a degree of discomfort that corresponds to the degree of excess pressure. This discomfort serves as direct biofeedback to the user, indicating that his or her grip is too tight and reminding the user to relax his or her grip. The rigidness of the tack-like units 18 improves the effectiveness of grip control glove 10. Specifically, when the user grips the equipment handle, the flat first side of rigid head portion 20 is forced to rest flat against the handle, thereby ensuring that protrusion 22, which extends perpendicularly from the second side of head portion 20, is generally perpendicular to the skin of the user's hand to maximize the effectiveness of the dull point in causing a sensation.

Repeated use of grip control glove 10 tends to train the user to use proper grip pressure which improves the user's swing. The biofeedback provided by glove 10 is a more direct form of feedback than the audible or vibrational feedback of known devices and provides a more effective means of teaching proper grip pressure. Further, the biofeedback is a sensation that inherently indicates the degree of excess pressure; consequently, the user is provided with a more accurate indication of the degree to which the grip should be relaxed.

In contrast to known handle-based grip pressure teaching devices, which are permanently integrated into a training golf club or must be moved from club to club, the grip control glove of the present invention can be used with conventional golf clubs, and only a single glove (or pair of gloves) is required to achieve training benefits with different golf clubs. Thus, for example, the glove can be worn while swinging a variety of different clubs while playing a round of golf. Further, the user can practice and play with the same set of golf clubs without any difference in the shape, feel and weight of the golf club handle itself. Thus, with the grip control glove of the present invention, the training conditions are more similar to non-training conditions than with known golf club handle training devices.

Further, the grip control glove of the present invention does not require a power source, pressure sensors, electronics, motors or alarms and is thus less costly than known devices that indicate grip pressure.

Having described preferred embodiments of a new and improved grip control glove, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A grip control apparatus for teaching proper grip pressure for gripping an item of sports equipment having a handle to be gripped, the apparatus comprising:

a glove having hollow finger portions adapted to receive fingers to be used for gripping and a palm portion adapted to cover at least a portion of a palm of a hand; and a tack-like unit having a head portion and a semi-sharp protrusion in the shape of a shaft extending from one side of the head portion and narrowing at a distal tip thereof to a dull point, said tack-like unit being attached to said glove, with the semi-sharp protrusion extending into an interior of said glove such that the dull point of the semi-sharp protrusion is oriented to impinge on a finger disposed within one of the hollow finger portions or the palm of the hand, the semi-sharp protrusion causing an uncomfortable sensation in the finger or palm when excessive grip pressure is applied by the finger or the palm to the handle.

2. The apparatus according to claim 1, wherein said tack-like unit is one of a plurality of tack-like units disposed within at least one of: a plurality of the hollow finger portions of said glove; and the palm portion of said glove.

3. The apparatus according to claim 1, wherein the shaft is generally cylindrical or generally conical.

4. The apparatus according to claim 1, wherein the head portion and the semi-sharp protrusion of said tack-like unit comprise a material which undergoes virtually no bending or flexing during use.

5. The apparatus according to claim 1, wherein the head portion is disc-shaped with first and second generally flat sides.

6. The apparatus according to claim 5, wherein:

the first side of the head portion is attached to an interior surface of said glove; and the semi-sharp protrusion extends from the second side of the head portion.

7. The apparatus according to claim 6, wherein the head portion of said tack-like unit is permanently attached to said glove at a predetermined position.

8. The apparatus according to claim 6, wherein the head portion of said tack-like unit is removably attached to said glove, such that a position of said tack-like unit is adjustable.

9. The apparatus according to claim 8, further comprising:

an attachment strip disposed on the interior surface of said glove and providing a plurality of attachment points for the first surface of the head portion of said tack-like unit along the interior surface of said glove.

10. The apparatus according to claim 5, wherein:

the second side of the head portion is attached to an exterior surface of said glove; and the semi-sharp protrusion extends from the second side of the head portion through a hole in said glove to an interior of said glove.

11. The apparatus according to claim 10, wherein the head portion of said tack-like unit is permanently attached to said glove at a predetermined position.

12. The apparatus according to claim 10, wherein the head portion of said tack-like unit is removably attached to said glove, such that a position of said tack-like unit is adjustable.

13. The apparatus according to claim 12, further comprising:

an attachment strip disposed on the exterior surface of said glove and providing a plurality of attachment points for the second surface of the head portion of said tack-like unit along the exterior surface of said glove, each of the attachment points having a corresponding hole adapted to receive the semi-sharp protrusion of said tack-like unit.

14. A method for teaching proper grip pressure for gripping an item of sports equipment having a handle to be gripped, the method comprising the steps of: forming a tack-like unit having a head portion and a semi-sharp protrusion in the shape of a shaft extending from one side of the head portion and narrowing at a distal tip thereof to a dull point;

attaching the tack-like unit to a glove, with the semi-sharp protrusion extending into an interior of the glove such that the dull point of the semi-sharp protrusion is oriented to impinge on a finger disposed within a hollow finger portion of the glove or a palm of a hand disposed within the glove; and causing an uncomfortable sensation in the finger or the palm with the semi-sharp protrusion when excessive grip pressure is applied by the finger or the palm to the handle.

15. The method according to claim 14, wherein said attaching step includes attaching a first side of the head portion of the tack-like unit to an interior surface of the glove, with the semi-sharp protrusion extending from a second side of the head portion.

16. The method according to claim 14, wherein said attaching step includes attaching a side of the head portion of the tack-like unit to an exterior surface of the glove, with the semi-sharp protrusion extending from the side of the head portion through a hole in the glove to an interior of the glove.

17. The method according to claim 14, wherein said attaching step includes permanently attaching the head portion of the tack-like unit to the glove at a predetermined position.

18. The method according to claim 14, wherein said attaching step includes removably attaching the head portion of the tack-like unit to the glove, such that a position of the tack-like unit is adjustable.

* * * * *